US006183316B1

(12) United States Patent
Morris

(10) Patent No.: US 6,183,316 B1
(45) Date of Patent: Feb. 6, 2001

(54) CONNECTOR WITH REDUNDANT CONTACT POINTS

(75) Inventor: Terrel L. Morris, Garland, TX (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 09/422,879

(22) Filed: Oct. 21, 1999

(51) Int. Cl.[7] ..... H01R 4/48

(52) U.S. Cl. ..... 439/862

(58) Field of Search ..... 439/862, 891, 439/637, 515, 80, 81, 83

(56) References Cited

U.S. PATENT DOCUMENTS 3,382,575 * 5/1968 Gannoe ..... 439/862
4,188,715 * 2/1980 Ammon et al. ..... 29/629
5,207,598 * 5/1993 Yamada et al. ..... 439/636

* cited by examiner

*Primary Examiner*—Renee Luebke
*Assistant Examiner*—P Nguyen
(74) *Attorney, Agent, or Firm*—Steven L. Webb

(57) ABSTRACT

A connector with multiple redundant contact points is disclosed. The multiple contacts are formed by a main contact point on a main beam and an auxiliary contact point connected to the main beam by a secondary beam in the shape of a loop or spring.

2 Claims, 3 Drawing Sheets

CONNECTOR WITH REDUNDANT CONTACT POINTS

RELATED APPLICATIONS

The application "A bifurcated contact with a connecting member that can add redundant contact points to single point connectors" that has the H.P. docket number 10991070 is related to this application and is hereby incorporated by reference. The application "A bifurcated contact with a connecting member at the tip of the contact that provides redundant contact points" that has the H.P. docket number 10991065 is also related to this application and is hereby incorporated by reference. Both the above referenced applications were filed on the same day as this application.

FIELD OF THE INVENTION

The present invention relates generally to connectors and more specifically to an edge connector with multiple redundant contact points.

BACKGROUND OF THE INVENTION

Personal computers come with many standard features, however some features are not shipped with all personal computers. A user can add additional capabilities to a computer by installing additional printed circuit (PC) boards, (sometimes referred to as daughter cards) into the computer. These daughter cards are typically added by installing the daughter cards into edge connectors that are mounted on the main processor board (motherboard) of the personal computer. The daughter cards (102) typically have pads (104) along the edge of the board that make contact with the individual contacts (106) in the edge connector (108). These connections between the pads (104) on the daughter card and the contacts (106) in the edge connectors serve as the electrical connection between the computer motherboard and the daughter cards. The edge connectors make the electrical connection to the plated area, or pad (202), on the daughter card (208) by providing an exerting force (206) (sometimes referred to as the normal force) to the contact (204) to push the contact firmly against the pad (see FIG. 2). Unfortunately edge connectors have a number of problems that affect the reliability of the connections between the pads and the contact points in the edge connector.

One problem is that the pads on the daughter card can get dirty. This can affect the connection in two ways. First, the pads can be covered or splattered with a contaminant that forms a thin film. If the film is not displaced by a wiping action as the daughter card is inserted into the edge connector, the film can prevent the contact from touching the pad and making electrical connection with the pad. The amount of force or contact pressure between the pad and the contact point is a delicate balance between contact area and the normal force. When the contact area is relatively small with respect to the normal force, the contact pressure is high, and the contact can rip or wear plating from the surface of the pad. When the contact area is relatively large with respect to the normal force, the contact pressure is low, and the contact can fail to displace or wipe off the insulating surface contaminants, resulting in contact failure. Unacceptably high insertion force can result when a connector has a large number of contacts and a high normal force at each contact. Some edge connector applications, for example a test fixture, require a high number of insertion cycles over the life of the connector. In these applications a low normal force is desired to minimize the wear on the contacts and pads to extend the life of the connector. Today, typically a normal force of approximately 10 grams per contact is considered a low normal force and approximately 100 grams per contact is considered a high normal force.

Second, when the dirt on the daughter card is in the form of particles, the particles can wedge between the contact and the pad, lifting the contact away from the pad and preventing electrical connection to the pad. Other problems that can occur with edge connectors include plating defects on the pads, poor alignment of the contacts to the pads, and susceptibility to thermal changes, due to contact movement on the pad surface.

These problems are indicative of a common characteristic of edge card connectors, a single point of contact between the connector and the pad surface on the daughter card. This extremely small single point of contact can be rendered ineffective by plating defects, surface contamination, excessive wear, poor alignment, and motion. The result is that the entire interconnection can fail due to a small problem at a critical point. Making multiple redundant contacts between the connector and the plated surface of the daughter card can reduce these problems. By providing at least two contact points for each connector pin the chance that a random localized particle, film, dust or other contaminant will be able to cause a connector failure has been greatly reduced.

There are a number of ways that multiple redundant contacts can be implemented. One way is to send one signal to two different contacts connected to two different pads. This method can be used without any changes to current connector design. Unfortunately this method reduces the total number of signals that can be sent through the connector. If each signal were sent over two contacts the total number of signals that can be sent through the connector would be cut in half Sending each signal to two different pads also increases the capacitance for each signal reducing the maximum operational frequency for the connector.

Another method to implement multiple redundant contacts is to cut the end of the contact into two prongs (see FIG. 3). This method creates two contact points (302) on the same pad. By creating two contact points on one pad the number of signals sent through the connector is not reduced. Multiple contacts on one pad also reduce the overall contact resistance. The multiple contacts form a parallel circuit and the resistance of parallel circuits is a function of the resistance per element, divided by the number of elements. Unfortunately when localized surface imperfections are present on the daughter card and one or both of the split contacts snag the imperfection during card insertion, locally high stresses can be inflicted into one or both of the split contacts. This can result in catastrophic contact failure and permanent damage to the connector. Because the connector manufacturer only makes the connector half of the mating pair of connector/daughter card, the connector manufacturer can not prevent this problem by controlling for surface imperfections of the daughter card.

Edge connectors are used in a wide variety of applications in addition to personal computers. The descriptions using personal computers as examples are for clarity of understanding and are not meant to limit the invention to edge connectors in personal computers. Accordingly there is a need for an improved multiple redundant contact that can withstand surface imperfections during card insertion.

SUMMARY OF THE INVENTION

The present invention is a connector with multiple redundant contact points that can withstand surface imperfections during card insertion. One embodiment is a connector with a main contact point on a main beam and an auxiliary contact point connected to the main beam by a secondary beam in the shape of a loop or spring.

Other aspects and advantages of the present invention will become apparent from the following detailed description, taken in conjunction with the accompanying drawings, illustrating by way of example the principles of the invention.

DETAILED DESCRIPTION OF THE PREFERRED EMBODIMENT

The preferred embodiment is an edge connector with a main contact point on a main beam and an auxiliary contact point connected to the main beam by a secondary beam in the shape of a loop or spring can withstand the high stress caused by surface imperfections during card insertion. By providing a connector with multiple contacts that can withstand the high stresses caused by surface imperfections, the advantages of multiple contacts can be obtained without an increase in the risk of contact failure.

In one embodiment the contact comprises a main beam (402) and a secondary beam (404). The main beam (402) is curved to create the main contact area (406) and to provide sufficient normal force to ensure reliable contact at the main contact area. Above the main contact area (406) the width of the main beam is reduced to form the secondary beam (404). The secondary beam (404) is curved to form a spring and provide a secondary contact area (408) that will contact the pad on the mating PC board above the main contact area (406). The spring shape of the secondary beam (404) provides sufficient normal force at the secondary contact area to enable a secondary point of reliable contact.

A balance of the normal forces (also called the spring force) between the main beam (402) and the secondary beam (404) is required for ideal operation of the contact. In a preferred embodiment of this configuration the spring force at the main contact area (406) is approximately equal to the spring force at the secondary contact area (408). It is well known in the art that the spring force of the main beam can be adjusted by changing the curvature of the main beam, changing the width or thickness of the main beam, changing the material of the main beam, or changing the cross sectional shape of the main beam.

The spring force of the secondary beam can also be adjusted by changing the curvature of the secondary beam, by changing the width and thickness of the secondary beam, or by changing the cross sectional shape of the secondary beam.

Figure 1:
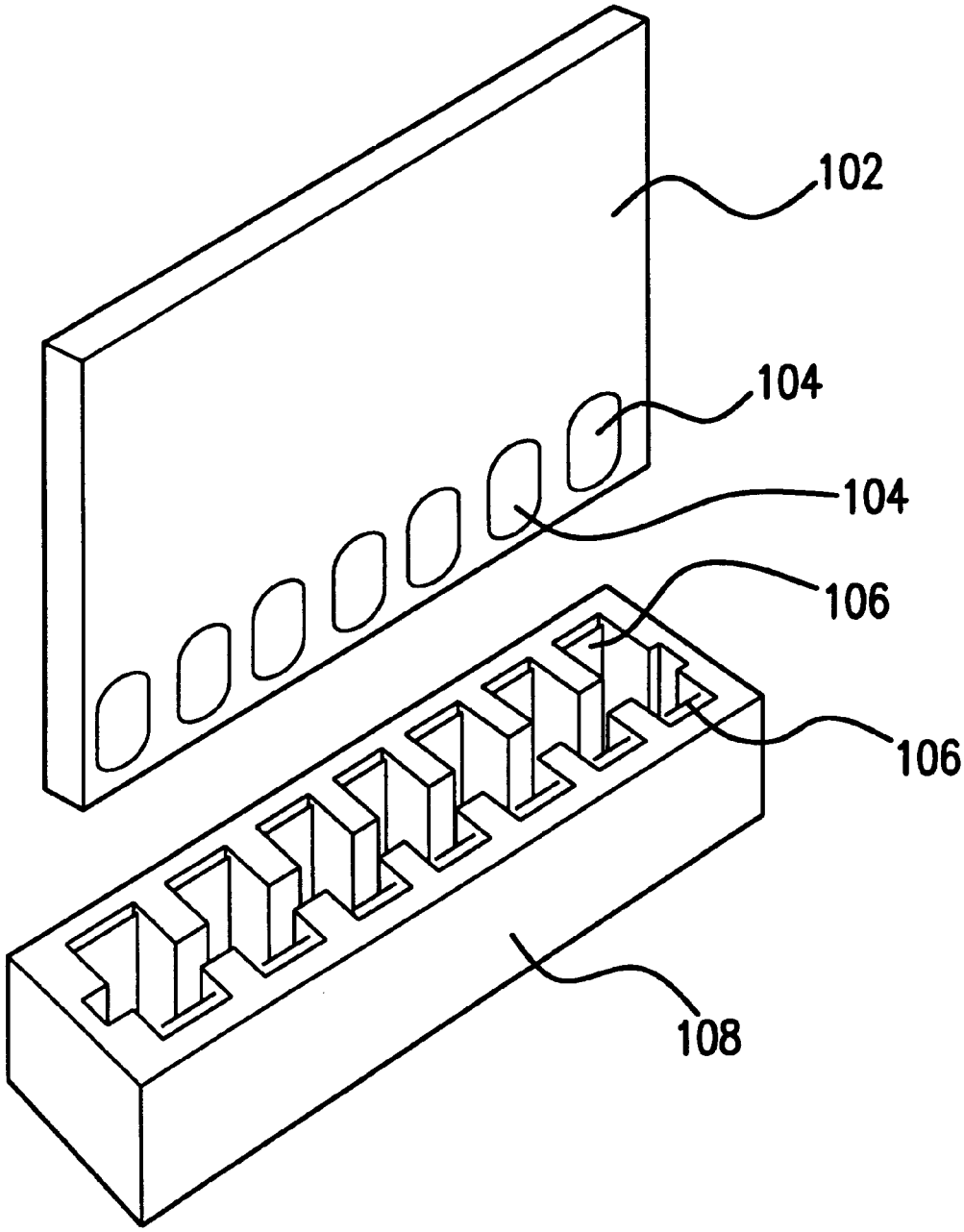
FIG. 1 (PRIOR ART)
FIG. 1 is a projection view of an edge connector and a daughter card.
Figure 2:
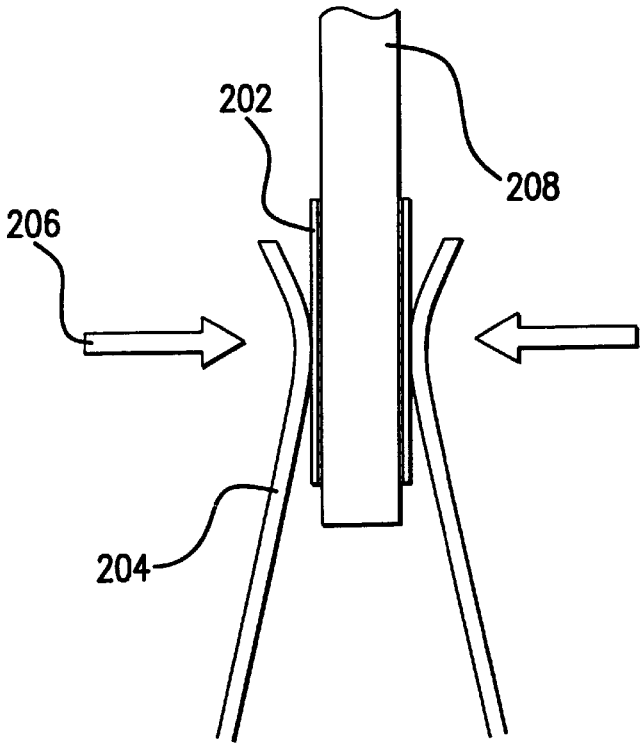
FIG.2 (PRIOR ART)
FIG. 2 is a force diagram of a daughter card inserted into an edge connector.
Figure 3:
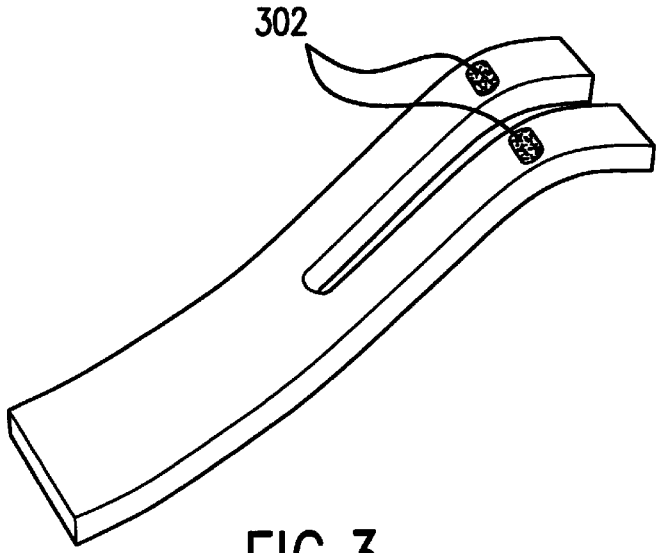
FIG.3 (PRIOR ART)
FIG. 3 is a projection view of a bifurcated contact from an edge connector.
Figure 5:
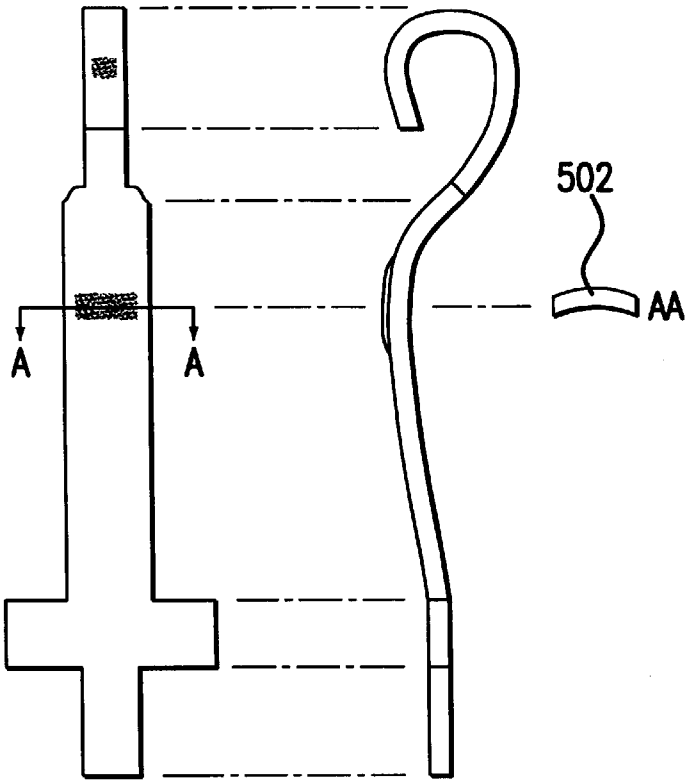
FIG. 5 is a drawing of a connector with a curved cross sectional shaped main contact point on a main beam and an auxiliary contact point connected to the main beam with a secondary beam in the shape of a loop or spring in accordance with the present invention.
Figure 4:
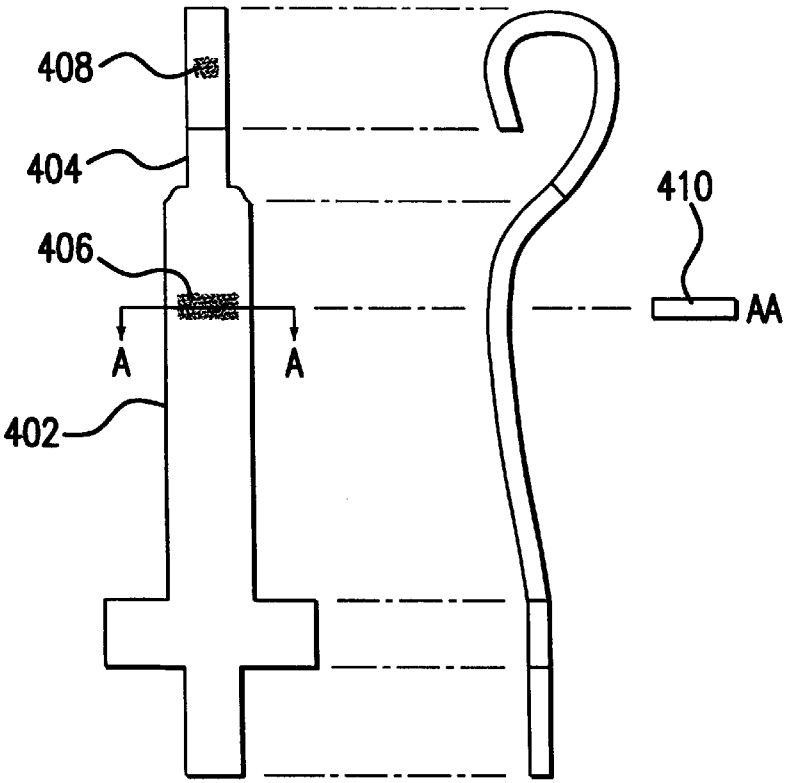
FIG. 4 is a drawing of a connector with a main contact point on a main beam and an auxiliary contact point connected to the main beam with a secondary beam in the shape of a loop or spring in accordance with the present invention.

The contact pressure of the contact points can be adjusted by changing the cross sectional shape in the contact area. A flat shape (410) would tend to maximize the contact area and produce the lowest contact pressure. A curved shape (see figure 5) would tend to minimize the contact area and produce high contact pressure. The contact area in the connector can be coined, or stamped and formed, to produce a curved or hemispherical cross sectional shape in the contact area (502).

In the preferred embodiment the ratio of the width of the main beam to the secondary beam is approximately ½ to ¾. The shape of the curve of the secondary beam and its direction of travel during deflection allows the secondary beam to curl when the contact area catches on a surface imperfection during board insertion. In contrast when a bifurcated contact snags a surface imperfection the forces tend to fold the contact into the curve of the tip. The shape and its direction of travel during deflection allows the secondary beam to withstand higher forces during insertion without a catastrophic failure.

During insertion of the mating PC board into the connector, the PC board first contacts and displaces the secondary contact area and then, after further insertion, the PC board contacts and displaces the main contact area. By displacing the two contact areas at different times the total insertion force is divided across two separate insertion events. This reduces the required force in each event making it easier to insert the card into the connector.

The foregoing description of the present invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A multiple redundant contact, comprising:

a main beam, the main beam having a first end and a second end and a width, the main beam is curved along the axis between the first end and the second end to form a first contact area near the first end of the main beam;

a secondary beam, the secondary beam having a first end and a second end and a width, the width of the main beam is larger than the width of the secondary beam, the secondary beam is curved along the axis between the first end and the second end to form a second contact area near the first end of the secondary beam;

the second end of the secondary beam is rigidly attached to the first end of the main beam.

2. The multiple redundant contact of claim 1 where:

the main beam generates a first normal force when displaced by a first displacement;

the secondary beam generates a second normal force when displaced by the first displacement;

the ratio of the width of the main beam to the width of the secondary beam balances the first normal force to be substantially equal to the second normal force.

* * * * *